US011473360B2

(12) United States Patent
Carnelos et al.

(10) Patent No.: US 11,473,360 B2
(45) Date of Patent: Oct. 18, 2022

(54) DEVICE FOR CONTROLLING THE OPENING/CLOSING OF DOOR WINGS OF A PIECE OF FURNITURE AND THE LIKE

(71) Applicant: FERRAMENTA LIVENZA S.R.L., Pordenone (IT)

(72) Inventors: Luca Carnelos, Maron di Brugnera (IT); Mattia Ciol, Maron di Brugnera (IT); Simone Della Rosa, Maron di Brugnera (IT); Abramo Ivan, Maron di Brugnera (IT); Davide Verziagi, Maron di Brugnera (IT); Christian Zonta, Maron di Brugnera (IT)

(73) Assignee: FERRAMENTA LIVENZA SRL, Maron di Brugnera (IT)

( * ) Notice: Subject to any disclaimer, the term of this patent is extended or adjusted under 35 U.S.C. 154(b) by 414 days.

(21) Appl. No.: 16/634,802

(22) PCT Filed: Jul. 26, 2018

(86) PCT No.: PCT/IB2018/055601
§ 371 (c)(1),
(2) Date: Jan. 28, 2020

(87) PCT Pub. No.: WO2019/030598
PCT Pub. Date: Feb. 14, 2019

(65) Prior Publication Data

US 2020/0232265 A1 Jul. 23, 2020

(30) Foreign Application Priority Data

Aug. 11, 2017 (IT) ..... 102017000093526

(51) Int. Cl.
*E05F 3/10* (2006.01)
*E05F 1/10* (2006.01)

(52) U.S. Cl.
CPC ..... *E05F 3/10* (2013.01); *E05F 1/10* (2013.01); *E05Y 2900/20* (2013.01)

(58) Field of Classification Search
CPC ... E05F 3/10; E05F 1/10; E05F 15/627; E05F 15/643; E05Y 2900/20; Y10T 16/568
(Continued)

(56) References Cited

U.S. PATENT DOCUMENTS 3,136,903 A * 6/1964 Trott ..... G05B 19/02 68/12.23
8,925,696 B2 * 1/2015 Zeilenga ..... F16F 1/10 312/319.1

(Continued)

FOREIGN PATENT DOCUMENTS

DE 20 2008 002232 U1 4/2008
DE 20 2017 100850 U1 3/2017

(Continued)

OTHER PUBLICATIONS

Oct. 16, 2018 International Search Report issued in International Patent Application No. PCT/IB2018/055601.

(Continued)

*Primary Examiner* — Janet M Wilkens
(74) *Attorney, Agent, or Firm* — Oliff PLC

(57) ABSTRACT

A device for controlling the opening/closing of a door wing of a piece of furniture having a body having at least a sidewall and a back and defining an inner cavity, includes a casing mountable on the furniture body; an inextensible cable, associable at a first end with the door wing and extending with respect to the casing between a retracted position of the door wing in a closed position, and an extracted position of the door wing in an opened position, tilted downwards with respect to the body of the piece of furniture; and an elastic displacement connected to the cable (Continued)

and movable with respect to the casing. The casing is arranged outside the back, with a first guide provided for guiding the cable along the sidewall, and a second guide provided for perpendicularly deviating the cable with respect to the first guide.

11 Claims, 13 Drawing Sheets

(58) Field of Classification Search
USPC ..... 49/386, 325; 312/319.1–319.4, 319.7, 312/319.8, 327, 328
See application file for complete search history.

(56) References Cited

U.S. PATENT DOCUMENTS

| | | | | |
|---|---|---|---|---|
| 2006/0157990 | A1* | 7/2006 | Giovannetti | E05F 1/1058 292/262 |
| 2007/0108676 | A1* | 5/2007 | Zeilenga | F16F 9/12 267/69 |

FOREIGN PATENT DOCUMENTS

| | | | |
|---|---|---|---|
| EP | 1 691 016 | A1 | 8/2006 |
| EP | 2090732 | * | 8/2009 |
| IT | 0001413916 | | 9/2012 |
| WO | 2015/014814 | A1 | 2/2015 |
| WO | 2020074976 | * | 4/2020 |

OTHER PUBLICATIONS

Oct. 16, 2018 Written Opinion of the International Searching Authority issued in International Patent Application No. PCT/IB2018/055601.

* cited by examiner

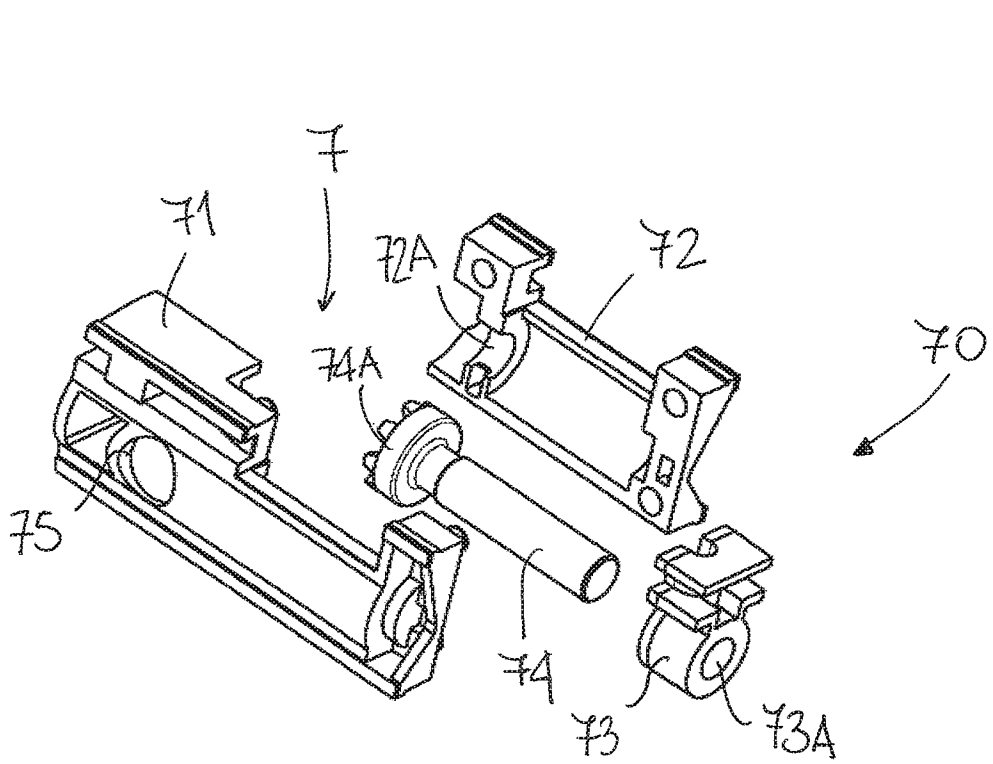
FIG. 12
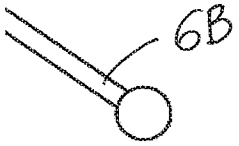

DEVICE FOR CONTROLLING THE OPENING/CLOSING OF DOOR WINGS OF A PIECE OF FURNITURE AND THE LIKE

TECHNICAL FIELD OF THE INVENTION

The present invention refers to a device for controlling the opening/closing of door wings for pieces of furniture and the like, in particular for a door wing rotatably mounted on a piece of furniture body and that can be opened by rotating it downwards so as to arrange itself basically parallel to the base of the piece of furniture or to the lower shelf of the cavity defined by the piece of furniture.

PRIOR ART TECHNIQUE

Many types of accessories are currently known in the art that allow to control the opening and/or closing of door wings of pieces of furniture by means of systems which slow down and accompany the final phase of the rotation motion when opening and closing in order to avoid the annoying collisions of the door wing on the piece of furniture frame or the breaking of the hinges when the user closes or opens the door wings too violently.

Generally such accessories comprise damping means or gas springs which require rather bulky containment shells and, consequently, bulky and unaesthetic housings on the piece of furniture as well.

Furthermore, the gas contained in such accessories is inevitably subject to leaks as it is difficult to make a perfect hermetic seal; therefore the damping action is prone to reducing its effect with time.

EP 1691016 A1 refers to a braking device for a door wing that can be opened downwards; a cable has one end fixed to the upper edge of the door wing and the other cable end fixed to the containment body of the device. An intermediate portion of the cable can be wound around a mobile pulley associated to a slider that can slide in a linear way along the containment body in contrast with a spring element; the opening of the door wing downwards puts into traction the spring element which slows down the door wing movement. The opposition to the linear sliding of the slider whereon the pulley is mounted is provided by a compression spring; the door wing opening downwards is therefore slowed down by the compression of the spring.

A drawback which can be observed in this braking device lies in the fact that the linear travel of the slider must allow the complete opening of the door wing, that is a 90° rotation with respect to the frame of the piece of furniture so that the door wing is able to place itself basically parallel to the lower shelf of a compartment of a piece of furniture; therefore the longitudinal dimension of the device must be such that it can allow the slider to make the complete opening travel. Consequently, the device must have a very extended longitudinal dimension, and it can therefore be applied only to pieces of furniture having a depth at least the same as the longitudinal extension of the device. This means that the device cannot be applied to those pieces of furniture having a reduced depth with respect to their height, such has wall units for bathrooms or living rooms.

Anyway, due to its big dimensions such braking device is aesthetically unsuitable even for those pieces of furniture whereon it can be applied.

As a partial solution to this drawback, patent IT1413916 envisages that the travel of the cable for the opening/closing of the door wing is returned by means of a rotor instead of a slider that slides in a linear way: in this way, the longitudinal extension of the whole device is rather reduced so that it can be applied without any substantial limitations even to those pieces of furniture that have a reduced depth with respect to their height.

Notwithstanding this device works satisfactorily, anyway it diminishes the inner usable room of the compartment of the piece of furniture; moreover, when the door wing is open, the device is completely visible.

SUMMARY OF THE INVENTION

Main object of the present invention is to provide a device for controlling the opening/closing of door wings for pieces of furniture and the like capable of overcoming the drawbacks of the prior art, that is, capable of taking up the minimal amount of space inside the cavity of the piece of furniture, thus being extremely functional to use.

In the field of the foregoing object, one of the scopes is that of producing a device for controlling the opening/closing of door wings for pieces of furniture and the like easy to assemble and which, with time, ensures a high level of robustness and reliability.

Not the least object of the present invention is that of providing a device for controlling the opening/closing of door wings for pieces of furniture and the like capable of achieving the foregoing object and purposes which is not expensive and can be produced using the common and known plants, machinery and equipment.

The foregoing object and purposes, and others that will be more apparent later, are achieved by a device for controlling the opening/closing of door wings for pieces of furniture and the like as defined in claim 1.

BRIEF DESCRIPTION OF DRAWINGS

Further characteristics and advantages that can be achieved by a device for controlling the opening/closing of door wings for pieces of furniture and the like according to the present invention will be more apparent by means of the following description of a particular but not excluding form of embodiment described for exemplification only but not limited to with reference to the following figures:

FIG. 12 shows an exploded view of a further advantageous component of a control device according to the present invention.

DETAILED DESCRIPTION OF THE INVENTION

Figure 1:
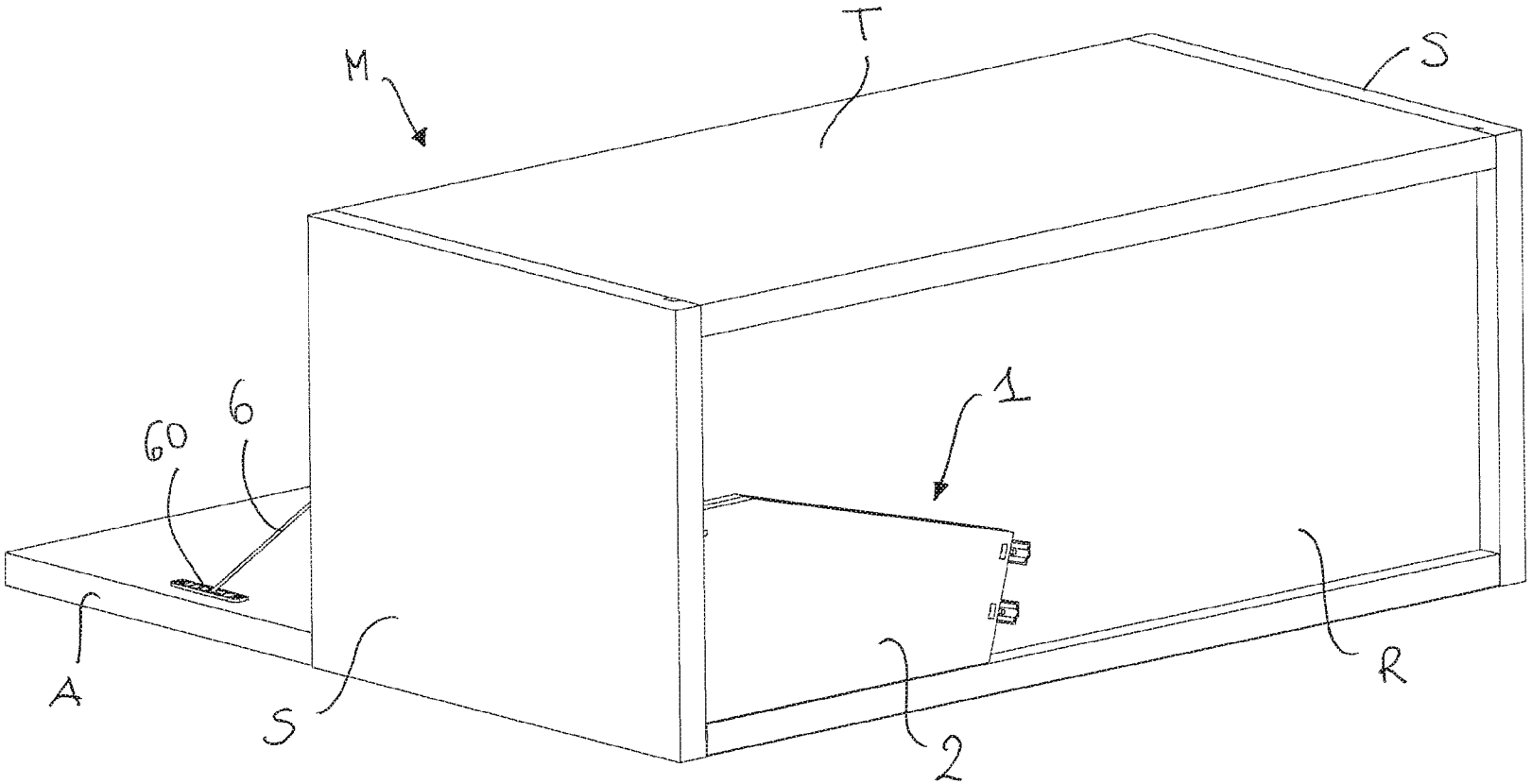
FIG. 1 shows a back perspective view of a piece of furniture whereon there is mounted a control device according to the present invention.
Figure 2:
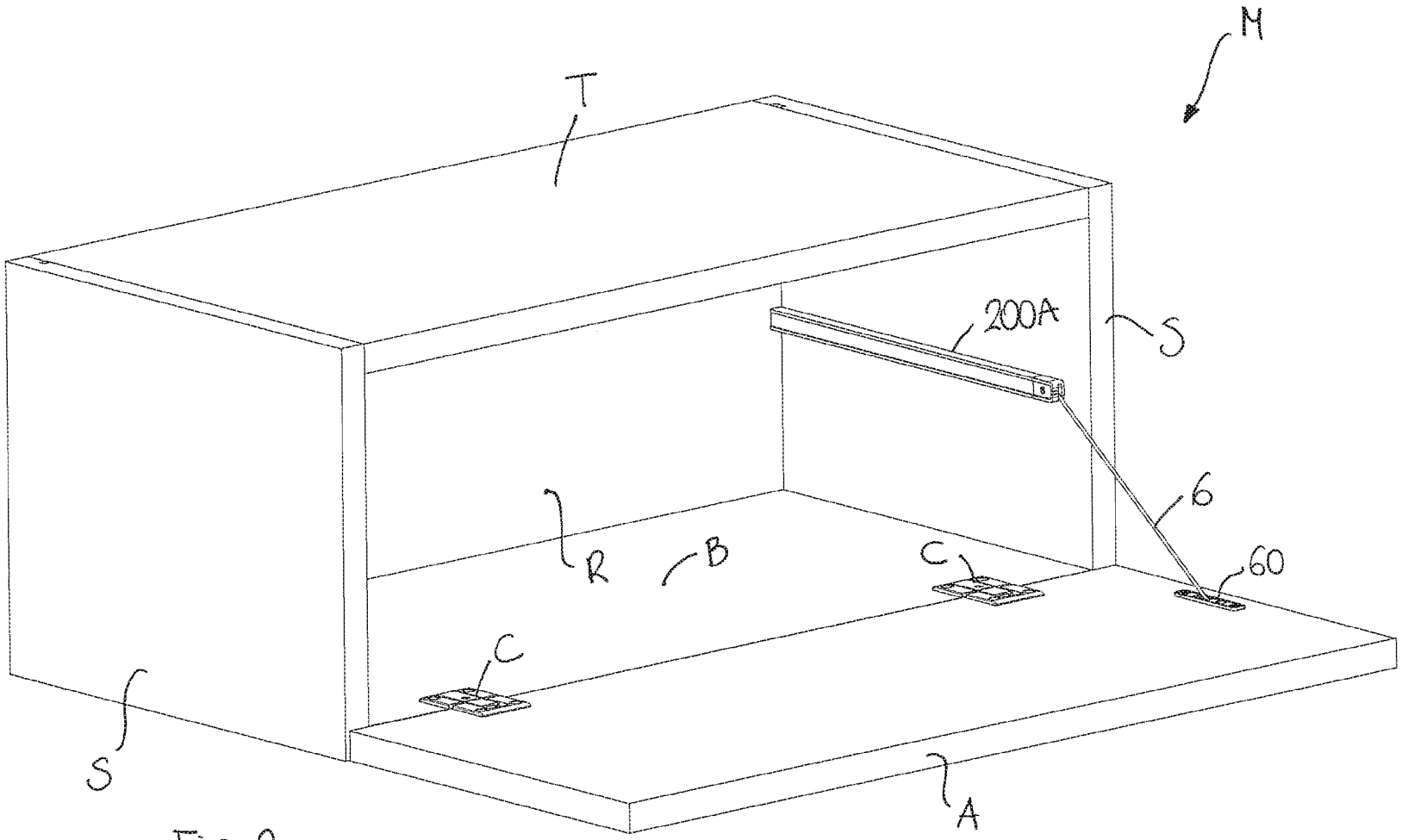
FIG. 2 shows a front perspective view of a piece of furniture whereon there is mounted a control device according to the present invention.

With particular reference to FIGS. 1 and 2, there is shown a device for controlling the opening/closing 1 of a door wing according to the present invention, adapted to be associated to a piece of furniture M having a parallelepiped body comprising at least a sidewall S, and preferably a pair of parallel sidewalls S, a back wall or back R, and a base B and possibly a top T.

Said piece of furniture M defines an inner cavity, wherein objects of different kinds can be stored, having a front opening which can be selectively closable by means of at least a door wing A rotatably constrained to the front edge of said base B about a basically horizontal articulation axis defined by suitable hinges C.

Said door wing A is adapted to be moved by the user, acting by means of suitable gripping means integral to it, such as one or more handles, between a closed position, where it lies on a basically vertical plane and stops against the front edges of said sidewalls S, and an opened position, where it lies on a basically horizontal plane, and is advantageously flush with the panel forming the base B of said piece of furniture M.

A control device 1 according to the present invention is suitable to be associated to said door wing A so as to guide and support its "tilted" movement both in the opening phase and in the closing phase.

Said device 1 advantageously comprises a hollow casing 2, that can be fixed to the body of said piece of furniture M, preferably formed by a first and a second half-shell 3, 4 advantageously internally configured so as to house suitable displacing means 100 adapted to control the movement of the door wing A.

Said device 1 further comprises a traction element 6, such as a cable basically inextensible, associable at a first end 6A, with the inner surface of said door wing A, and associated, at a second end 6B, with said displacing means 100 housed in a movable way in said casing 2, wherefrom said cable exits through an opening 5 obtained on the same casing, for example in one of said half-shells 3, 4.

In particular, said cable 6 extends, with respect to said casing 2, between a retracted position, wherein said door wing A is kept in a closed position, and an extracted position, wherein said door wing A is in an opened position with a rotation motion downwards with respect to the body of said piece of furniture M.

According to an advantageous characteristic of the present invention, said casing 2 is arranged outside the cavity of the piece of furniture M, so as not to take up the usable space for containing objects.

In particular, said casing 2 is arranged outside the panel forming the back R of the piece of furniture M, and preferably placed on the outer surface of the same, and it is advantageously arranged in a cavity formed between said back R and the wall against which the piece of furniture is leaning, defined laterally by the rear edges of said sidewalls S and in the lower part by the rear edge of the panel forming the base B of the piece of furniture.

Said casing 2 can be fixed by suitable and known fixing means, such as screws, directly on the back R of the piece of furniture M or, alternatively, it can be fixed on the rear edge of the sidewall S and/or on the rear edge of the base B, so as not to spoil the appearance of the inner compartment of the piece of furniture.

Advantageously, said device 1 comprises first guiding means 200 to support and guide said cable 6 between the opening 5 wherefrom it exits from said casing 2 and said anchoring means 60 arranged on said door wing A.

In particular, said device 1 comprises first guiding means 200A, adapted to guide said cable 6 along the sidewall S of the piece of furniture M in order to extend up to said door wing A, and are preferably formed by an internally grooved straight conduit adapted to be associated with the inner surface of said sidewall S and advantageously extending horizontally along most of the depth of said cavity defined by the piece of furniture M.

According to an advantageous characteristic of the present invention, said first guiding means 200A can possibly be arranged on the sidewall S at a height so as to be a support for a shelf housed in the inner cavity of the piece of furniture M.

Said second guiding means 200B are on the contrary provided for deviating said cable 6 with an orthogonal direction with respect to said first guiding means 200A, to allow the insertion of the second end 6B of said cable 6 inside said casing 2 and cooperate with the displacing means 100 housed therein.

Figure 3A:
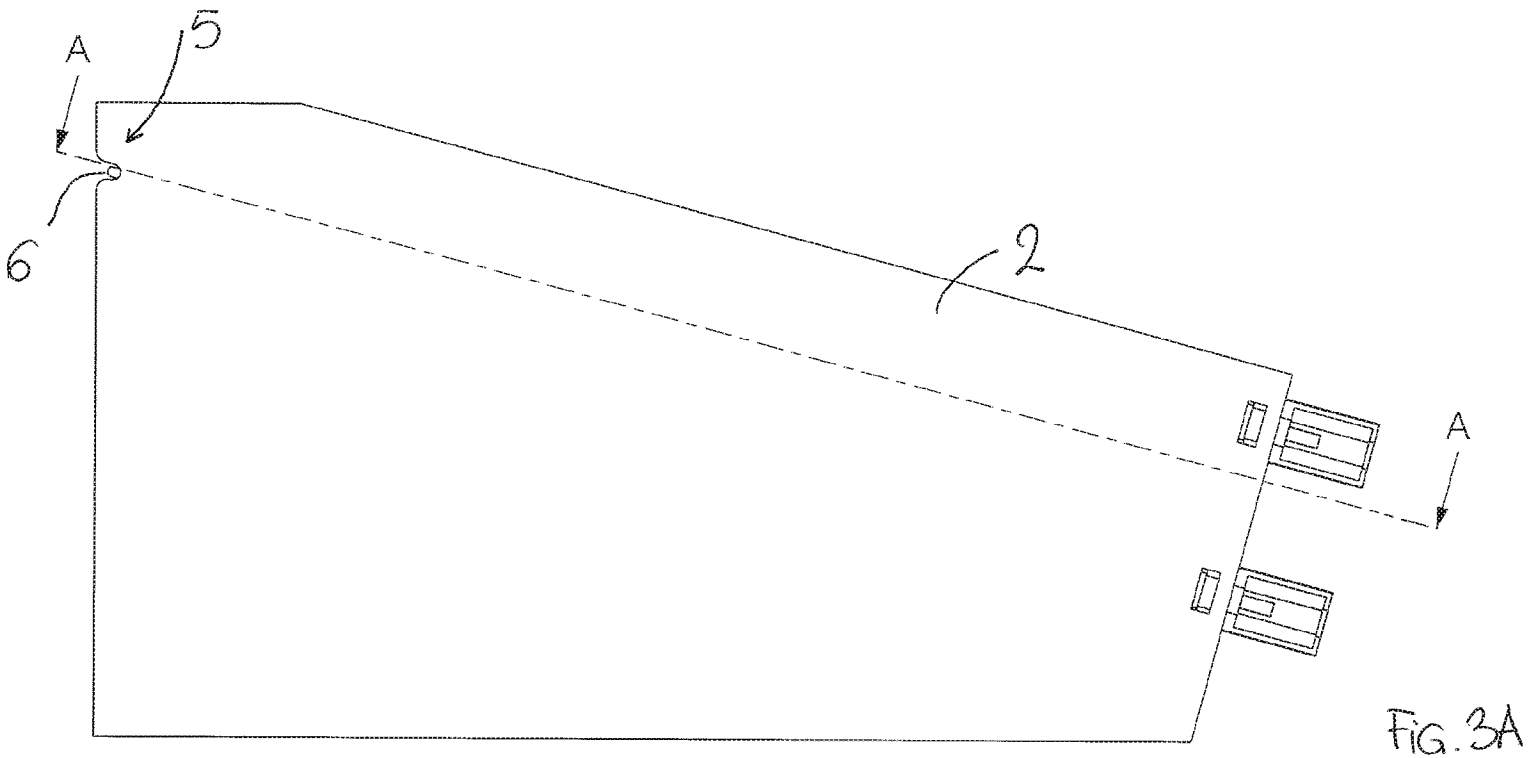
FIG. 3A is a front view of a component of the control device according to the present invention.
Figure 3B:
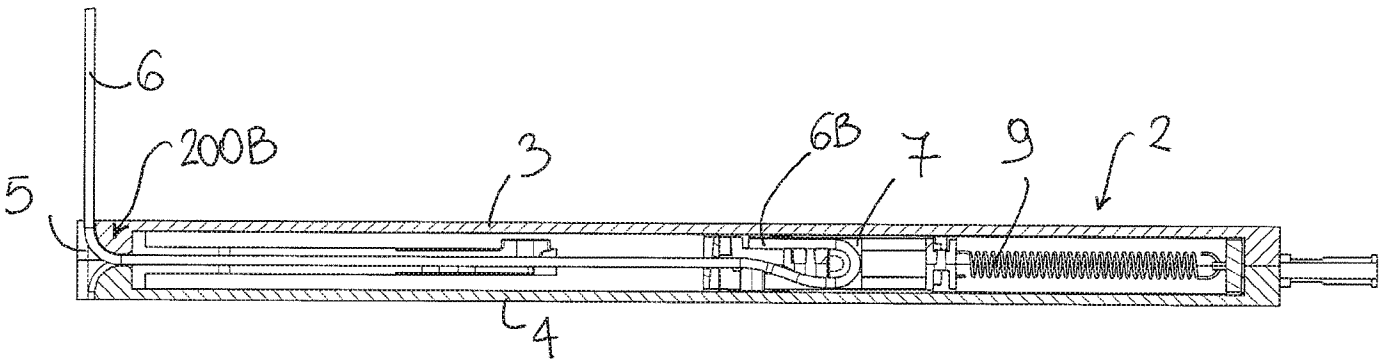
FIG. 3B is a view of the component of FIG. 3A, sectioned along the A-A.

Preferably, as shown in FIGS. 3A and 3B, said second guiding means 200B can be obtained in correspondence of said opening 5, suitably configured on said casing 2 to allow the exit of the cable 6 with an orthogonal direction with respect to the development of the same and of the displacing means 100 housed therein.

Alternatively, said opening 5 can be obtained on a portion of the said edge of said casing 2, so that said cable 6 can exit with a direction parallel to the plane defined by the back R, said second guiding means 200B being formed by a return element, such as a pulley fixed to the piece of furniture M arranged outside with respect to said casing 2, to deviate the cable 6 basically by 90° towards said first guiding means 200A.

Preferably, said displacing means 100 of the door wing comprise elastic means 9, such as at least a first spring operatively associated with said second end 6B of the cable 6 in order to control the opening of the door wing A and return the same to the closed position.

Advantageously, said at least first spring 9 is of the helical type and it is associated with sliding elements such as at least a first slide 7, slidably movable within said casing 2, preferably along a suitable grooved track and whereon said second end 6B of the cable 6 is anchored.

On said slide 7 there can possibly be provided recovering means of the length of said cable 6 (not shown in the figures), for example formed by one or more return pulleys, so as to limit the length of the same and therefore the length of the casing 2.

Furthermore, advantageously, said device 1 can comprise damping means 11, it too integral within the casing 2, that can be actuated by said sliding elements and adapted to start working when the door wing A is reaching the opened position.

In an alternative embodiment not shown, said at least first spring 9 is of the torsion type and it is associated with recovering means of the length of said cable, rotatably associated with the casing 2, such as a first rotor, preferably having a friction and comprising a pulley, whereon said cable 6 can be wound between a retracted position, wherein the door wing is kept in a closed position, and an extracted position wherein the door wing is opened tilted downwards with respect to the body of the piece of furniture.

Figure 4A:
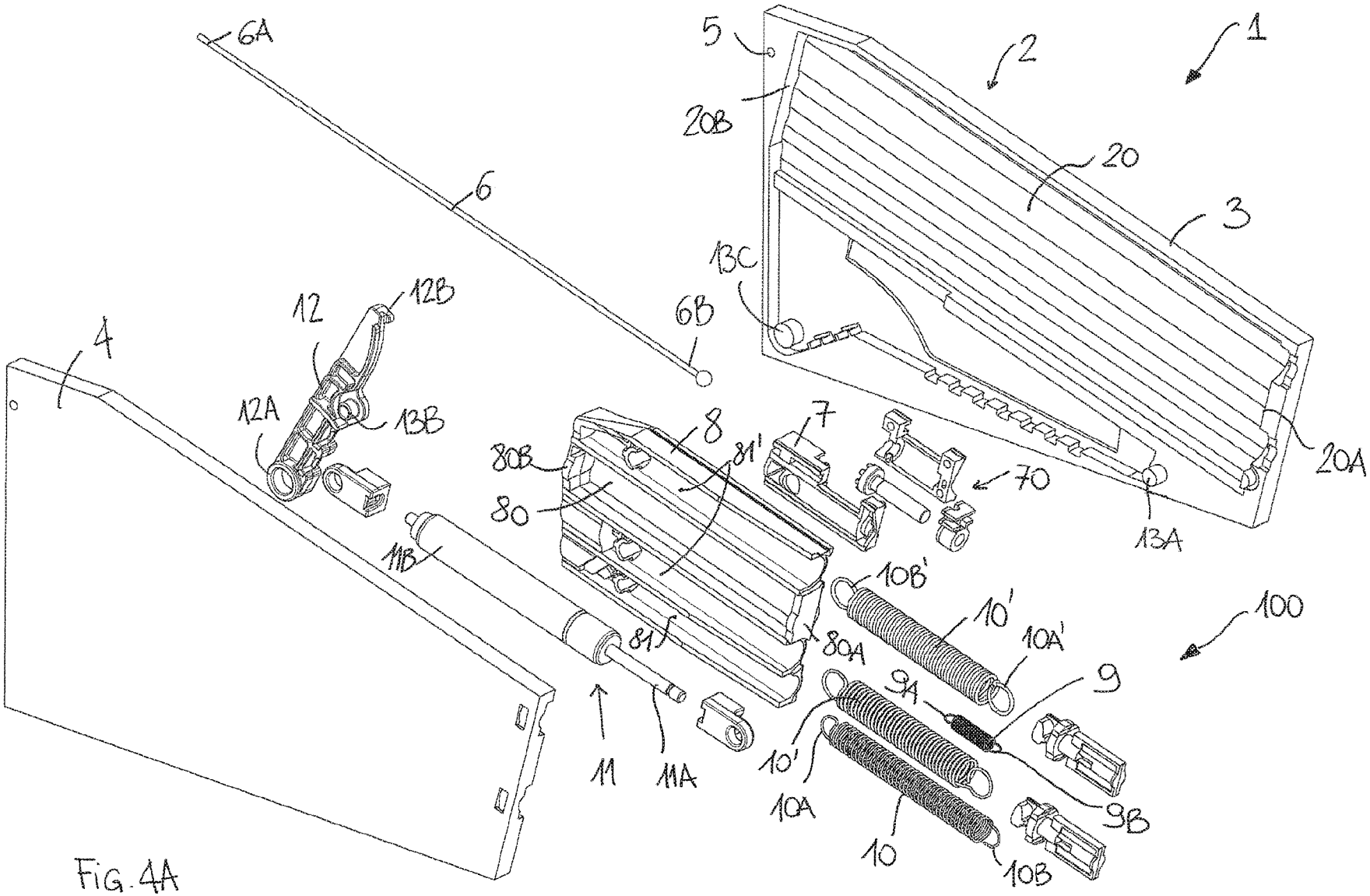
FIG. 4A shows an exploded view of a preferred embodiment of the device for controlling the opening/closing of a door wing according to the present invention.
Figure 4B:
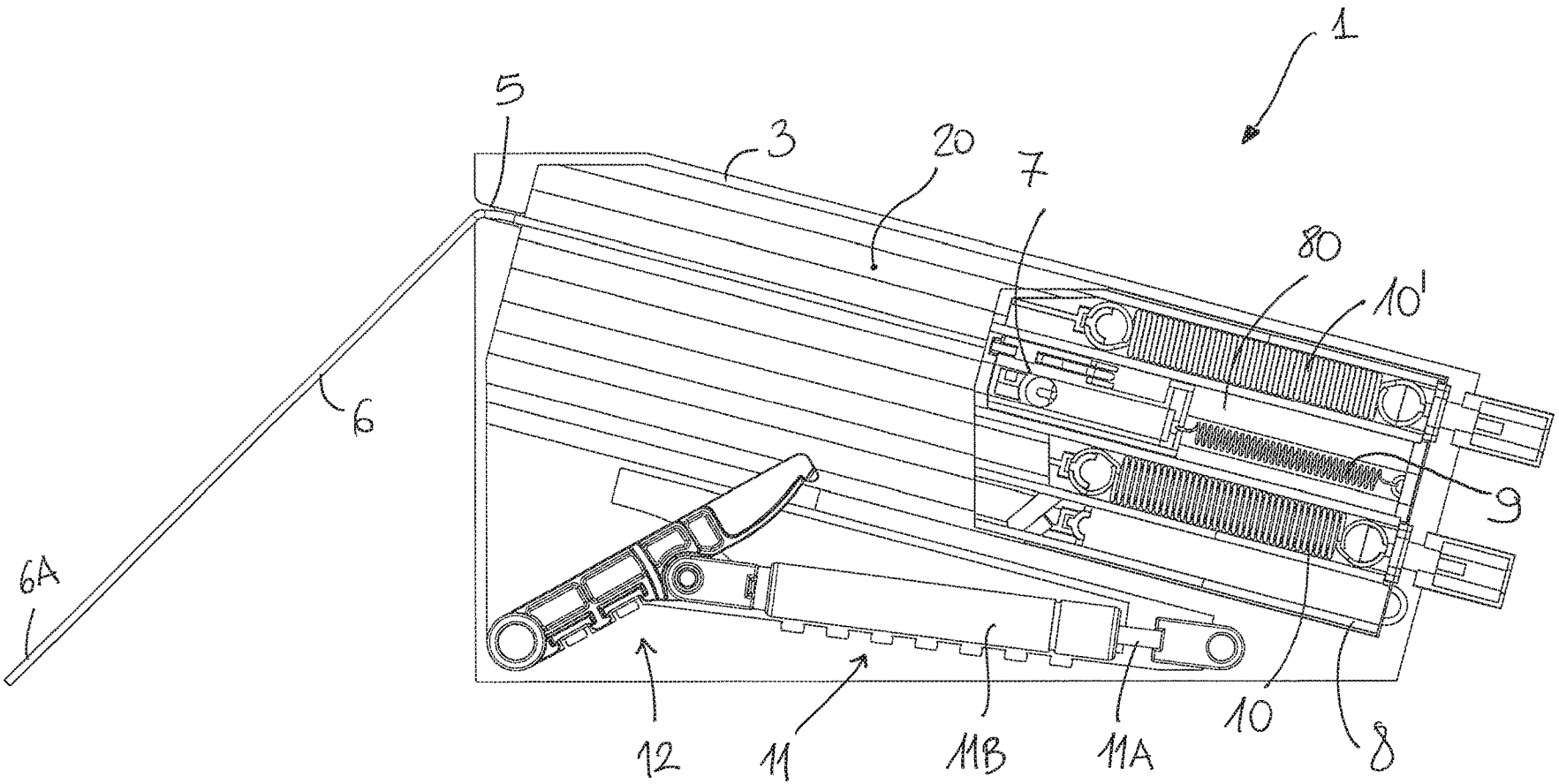
FIG. 4B shows a front view of the device of FIG. 4 when assembled.

According to a preferred embodiment of the invention shown in FIGS. 4A and 4B, said displacing means 100 of said control device 1 comprise a first sliding element 7, such as a first slide arranged in said casing 2 and slidably mounted on a second slidable element 8, such as a second slide, it, too, movable within said casing 2.

Advantageously, said second slide 8 is configured on its surface so as to define a first guiding track 80, along which said first slide 7 is freely slidable; advantageously, said first guiding track 80 is delimited by two end edges 80A, 80B and defines two stop positions for said first slide 7, and in particular a first stop position, wherein said first slide 7 is distal with respect to the opening 5 obtained on the casing 2, and a second stop position, wherein said first slide 7 is proximal to said opening 5.

Similarly, said casing 2, and in particular at least one of said two half-shells 3, 4, is internally configured so as to define a second guiding track 20 along which said second slide 8 is freely slidable. Advantageously, said second guiding track 20 is delimited by two end edges 20A, 20B, and defines respective stop positions for said second slide 8, and in particular a first stop position wherein said second slide 8 is distal with respect to the opening 5 obtained on the casing 2, and a second stop position, wherein said second slide 8 is proximal to said opening 5.

Preferably, as shown in the appended figures, said second guiding track 20 extends according to an inclined axis with respect to the horizontal one, so as to contain the dimensions of the casing 2 so that said opening 5 for exiting the cable 6 is arranged at a suitable height.

First elastic means 9, such as a first helical spring, are associated at a first end 9A with said first sliding element 7 and at the opposed end 9B with said second slide 8, and are adapted to elastically return said first slide 7 towards the respective first stop position, in correspondence of which said first spring 9 has basically a starting or a preloading condition.

Second elastic means 10, such as at least a helical spring, are associated with said second slide 8 to return the latter towards the respective first stop position. In particular, advantageously, said second spring 10 is associated at a first end 10A with said second slide 8, and at the opposed end 10B is associated with said casing 2, and preferably with a bottom wall of the same which is distal with respect to said opening 5.

Advantageously, said first end 10A of said second spring 10 is connected to said second slide 8 in correspondence of a front portion of the same, that is, arranged proximal to said opening 5, so as to allow a greater lengthening of the same spring; for this purpose, on said second slide 8 there is obtained a first groove 81, preferably arranged alongside and parallel to said first guiding track 80, within which said second spring 10 extends.

Possibly, according to an advantageous characteristic of the present invention said first elastic means 9 and said second elastic means 10 are configured so as to have a respective elastic return force of different intensity: in particular, preferably, said second elastic means 10 have an elastic return force of a greater intensity with respect to that exerted by said first elastic means 9.

For example, as it is apparent in the appended figures, said first elastic means 9 are formed by a helical spring having a smaller diameter with respect to that of the helical spring that form said second elastic means 10.

Furthermore, advantageously, said second elastic means can comprise one or more additional helical springs 10', they, too associable at a first end 10A' with said second slide 8, and at the opposed end 10B' with said casing 2, so as to allow to counterbalance the weight of door wings having greater dimensions and consequently greater weight. Said additional springs 10' can advantageously be activated or deactivated also when assembling the device 1 to the body of the piece of furniture M based on the weight of the door wing A to be controlled.

Similarly to said second spring 10, said additional helical springs 10' can extend within suitable additional grooves 81' obtained on said second slide 8, preferably arranged alongside and parallel with respect to said first guiding track 80 and to said first groove 81.

In accordance with a further advantageous characteristic of the present invention, said device 1 further comprises damping means 11, it, too, integral within said casing 2, adapted to be actuated when the door wing A is reaching the opened position; in particular, said damping means 11 is operatively associated with said second slide 8 through actuating means 12, as later described in greater detail.

Said damping means 11 basically comprises a shank 11A slidably inserted within a corresponding cylindrical casing 11B so that the telescopic movement between them is contrasted by braking means, such as a viscous fluid contained in said cylindrical casing 11B.

Preferably, said shank 11A is associated at its free end with the casing 2, about a first rotation pin 13A advantageously arranged in a distal area with respect to the opening 5 for exiting the cable 6, while the free end of said cylindrical casing 11B is integral with said actuating means 12, in particular formed by a lever arm.

Said arm 12 is preferably articulated at the free end of said cylindrical casing 11B about a second pin 13B basically arranged at an intermediate position with respect to the extension of the same arm 12, and it is firmly fixed with a first end 12A to said casing 2, about a third rotation pin 13C.

Advantageously, said arm 12 is preferably arranged so that, when said damping means 11 is in a resting condition, that is when said shank 11A is basically completely retracted within the cylindrical casing 11B, its second end 12B overlaps said second guiding track 20, and advantageously in correspondence of an intermediate portion with respect to the extension of the same, therefore interfering with the sliding movement of said second slide 8.

Hereinafter there is shown the operation of a control device according to the embodiment of the present invention previously described with reference to FIGS. 5 to 8.

Figure 5:
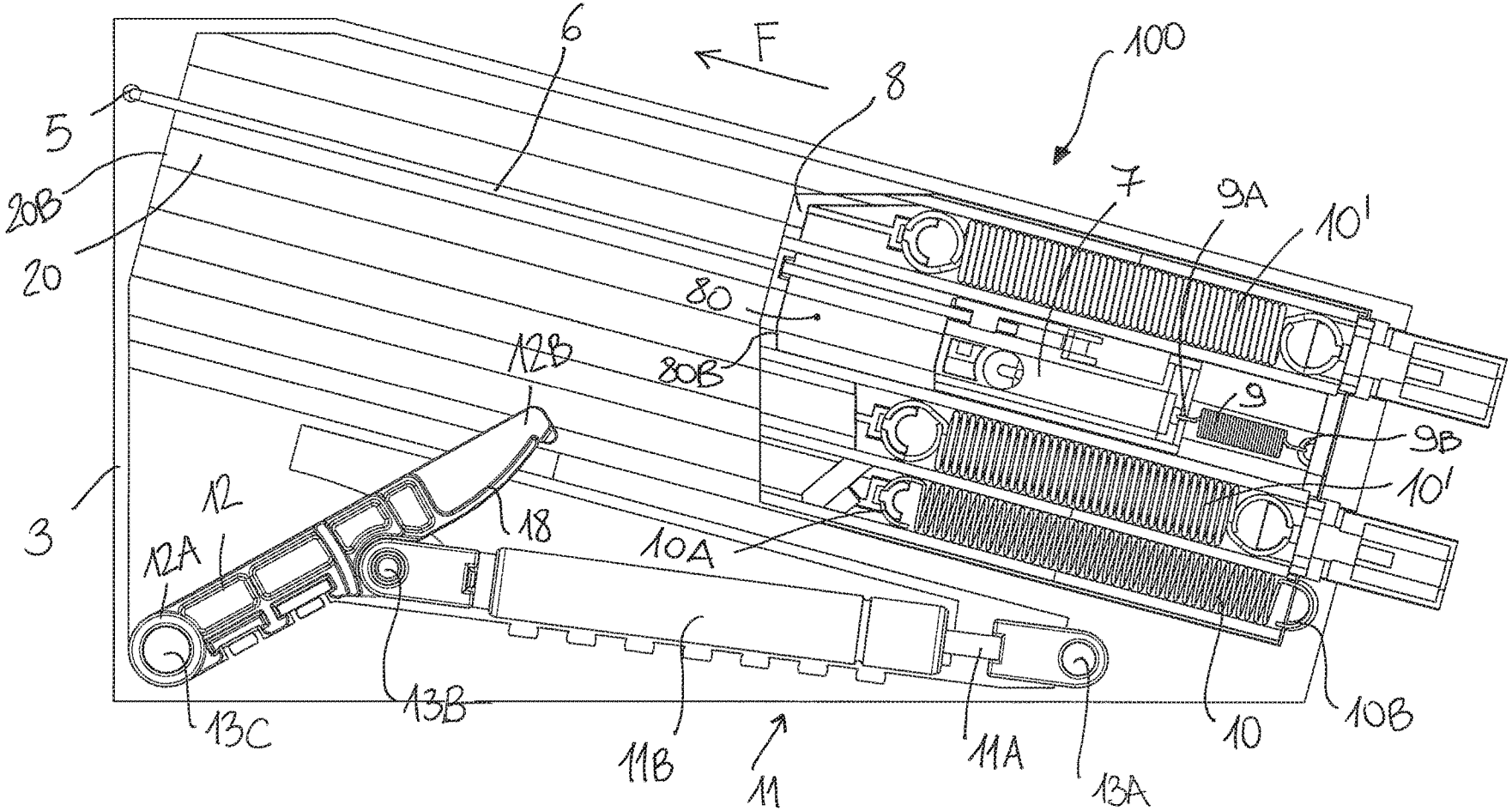
FIG. 5 shows a side section view of the device of FIG. 4A when assembled having the door wing closed.

In FIG. 5 there is shown the device 1 in a configuration that basically corresponds to a condition wherein the door wing A is in a closed position. In this configuration, said first slide 7 is arranged in the first stop position within the respective first guiding track 80, that is in the vicinity of a first edge end 80A of the same, with said first spring 9 interposed and in a starting preloading condition; said second slide 8 is, in turn, arranged in the first stop position, stopped or in the vicinity of a first end edge 20A of the respective second guiding track 20, with said second spring 10 in a starting preloading condition. In particular, the starting preloading condition of said springs 9, 10 is set so as to firmly keep said door wing A in the closed position. Said damping means 11 is on the contrary in a resting position, with the shank 11A basically inserted in the respective cylindrical casing 11B.

When the door wing A is being opened, the cable 6 is put into traction, transmitting to the first slide 7 to which it is fixed, a tractive force that provokes its sliding movement along said first guiding track 80 in the direction shown by the arrow F; this movement is contrasted by the elastic action of said first spring 9 which, in this first opening phase, prevents the door wing A from acquiring a high speed.

In this condition, the friction developed by the sliding of the first slide 7, dragged by the weight of the door wing A, within the first guiding track 80 can give a progressive sliding movement also to said second slide 8, in contrast with said second spring 10, in particular if said first and said second spring 9, 10 have basically the same return force, or the difference of intensity between the two is not high.

On the contrary, if said second spring 10 has a return force much greater than that of the first spring 9, so as to overcome the friction force developed by the sliding of the first slide 7, in the first opening phases of the opening of the door wing A said second slide 8 basically remains in the first stop position, that is stopped or in the vicinity of said first end edge 20A of the second guiding track 20.

Figure 6:
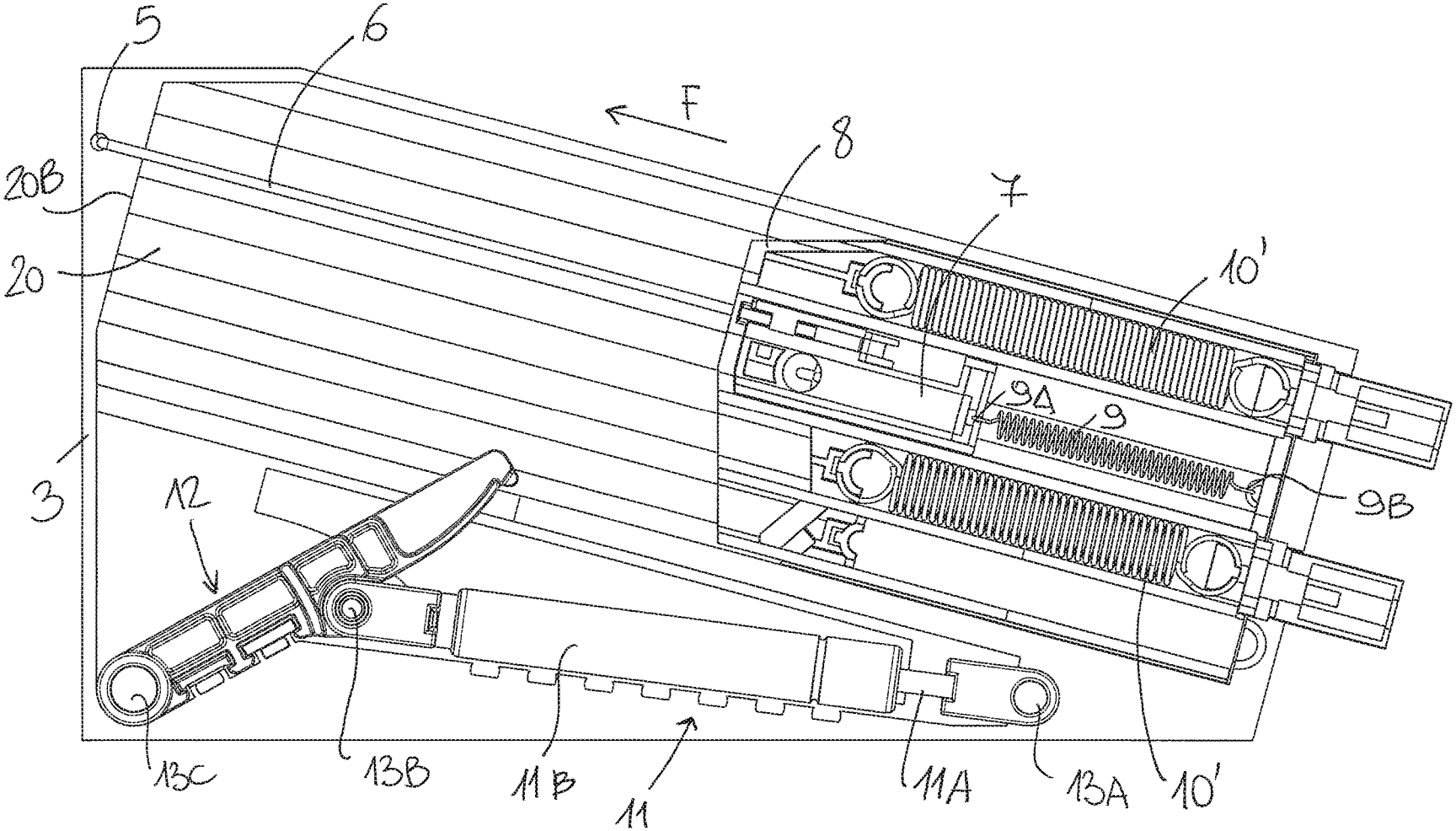
FIG. 6 shows a side section view of the device of FIG. 4A when assembled in a first phase of the opening movement of the door wing.

As shown in FIG. 6, when the door wing A has been displaced by a rotation having a width of a first angle $\alpha$ such as of about 20° with respect to the closed position, said first slide 7 reaches the second stop position, defined by a second end edge 80B of said first guiding track 80 obtained on said second slide 8, which possibly may have undergone a certain translation motion within the respective guiding track 20.

At this stage, further rotations of the door wing A in the opening direction cause the first slide 7 to transfer the stress on the cable 6 to the second slide 8, becoming integral to it, and slidably dragging the latter along the respective second guiding track 20 towards the relative second stop position, in the direction shown by the arrow F of FIG. 6.

Anyway, the sliding of said second slide 8 is elastically contrasted by said second spring 10, which exerts an elastic return action of the same towards the first stop position.

Figure 7:
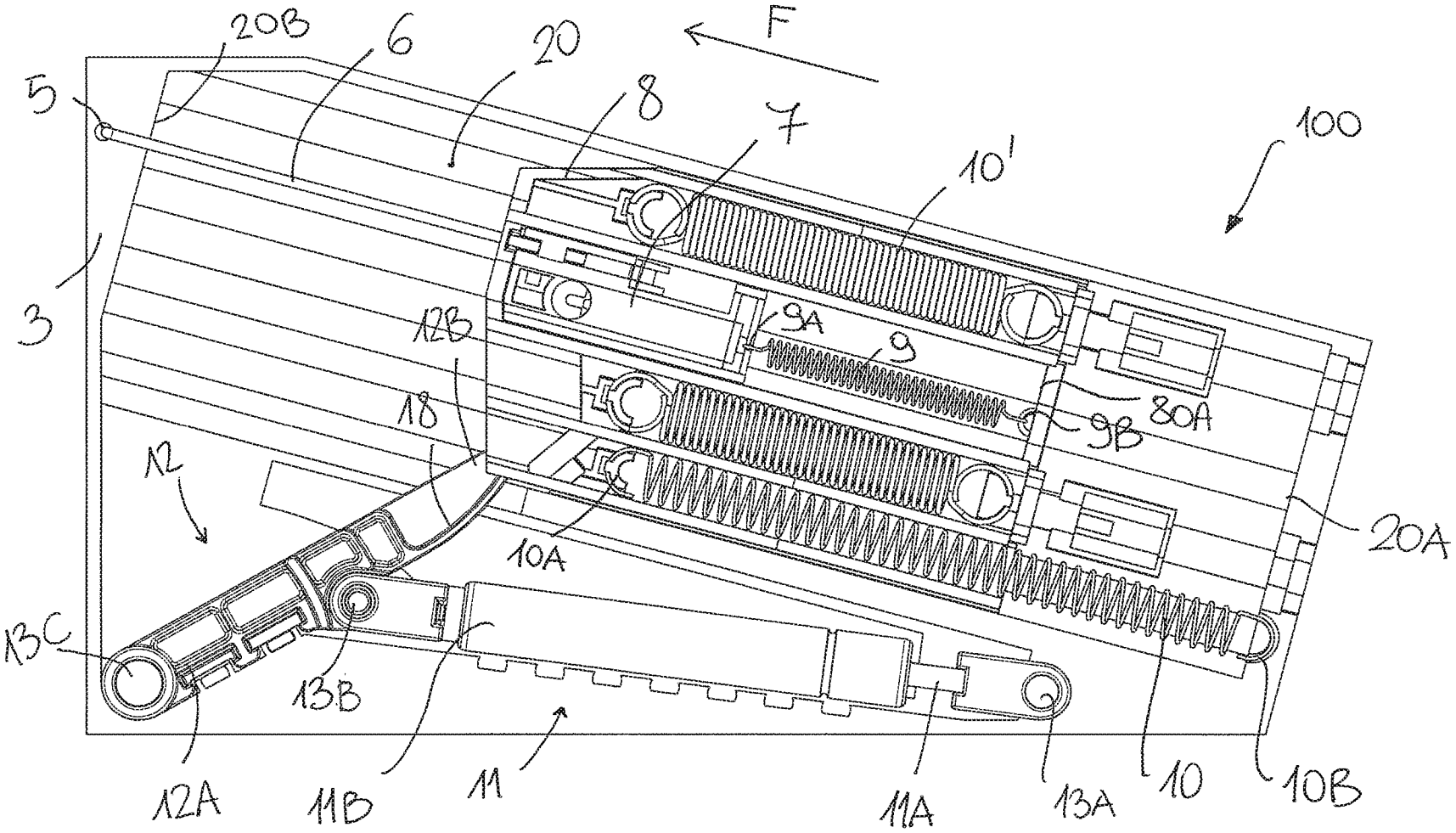
FIG. 7 shows a side section view of the device of the FIG. 4A when assembled in a second phase of the opening movement of the door wing.

As the door wing A continues the rotation motion towards the opened position, the cable 6 progressively pulled by the weight of the door wing A drags said second slide 8, by means of the engagement with said first slide 7, along said second guiding track 20: advantageously, when the door wing A makes a rotation of a width of a second angle $\beta$ with respect to the closed position, for example of about 45°, said second slide 8 comes into contact with the free end 12B of said lever arm 12, as shown in FIG. 7.

From now on, the rotation of said door wing A towards the opened position is therefore elastically contrasted by the action of said first spring 9, that tends to elastically return said first slide 7 towards the relative first stop position, by the action of said second spring 10, that tends to return said second slide 8 towards the relative first stop position, and finally by the damping action of said damping means 11, which is stimulated by the interference between the free end 12B of said arm 12 and the travel of said second slide 8.

Advantageously, the viscous fluid within said damping means 11 contrasts the extraction telescopic movement of said shank 11A with respect to said cylindrical casing 11B, therefore further limiting the descent speed of the door wing A and thus avoiding the final opening impact.

Thanks to the reciprocal arrangement of said actuating arm 12 and said damping means 11, the actuation of the latter is obtained by means of a lever mechanism which allows to produce a progressive braking force on said slide 8.

Figure 8:
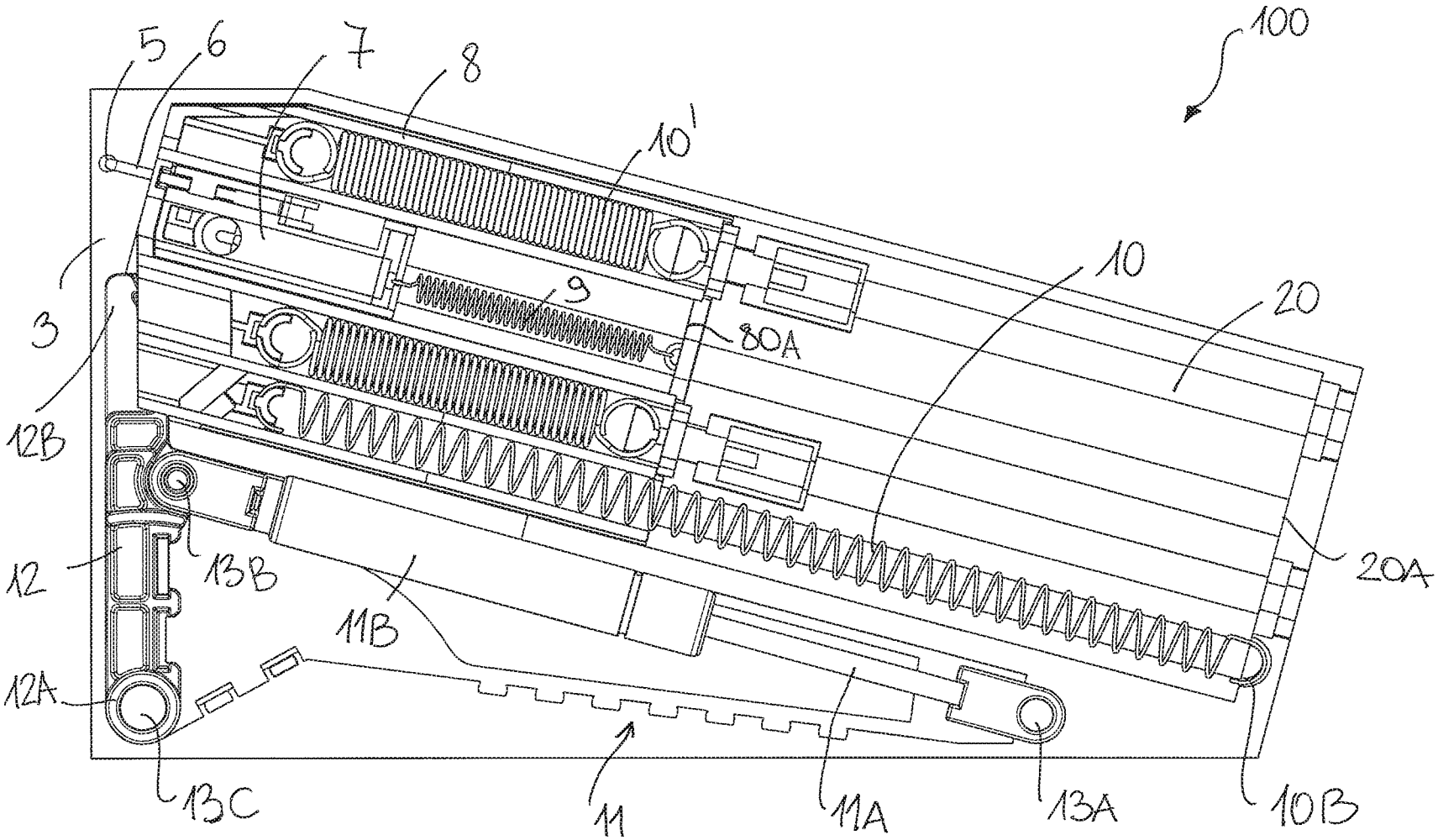
FIG. 8 shows a side section view of the device of FIG. 4A when assembled when the door wing is completely opened.

As shown in FIG. 8, upon reaching the opened position of the door wing A, said cable 6 is in the position of maximum extraction with respect to said casing 2, since its second end 6B is situated in the vicinity of said exit opening 5. Both said first slide 7 and said second slide 8 are in the respective second stop position in the relative first and second guiding track 80, 20, respectively in contrast with the action of said first spring 9 and said second spring 10 which are extended to the maximum. Finally, said shank 11A is extracted up to its maximum with respect to the relative casing 11B.

Upon the closing of the door wing A, the tension on the cable 6 is progressively reduced; said first and second springs 9, 10 therefore return said first and said second slide 7, 8 towards the relative first stop position.

Figure 9B:
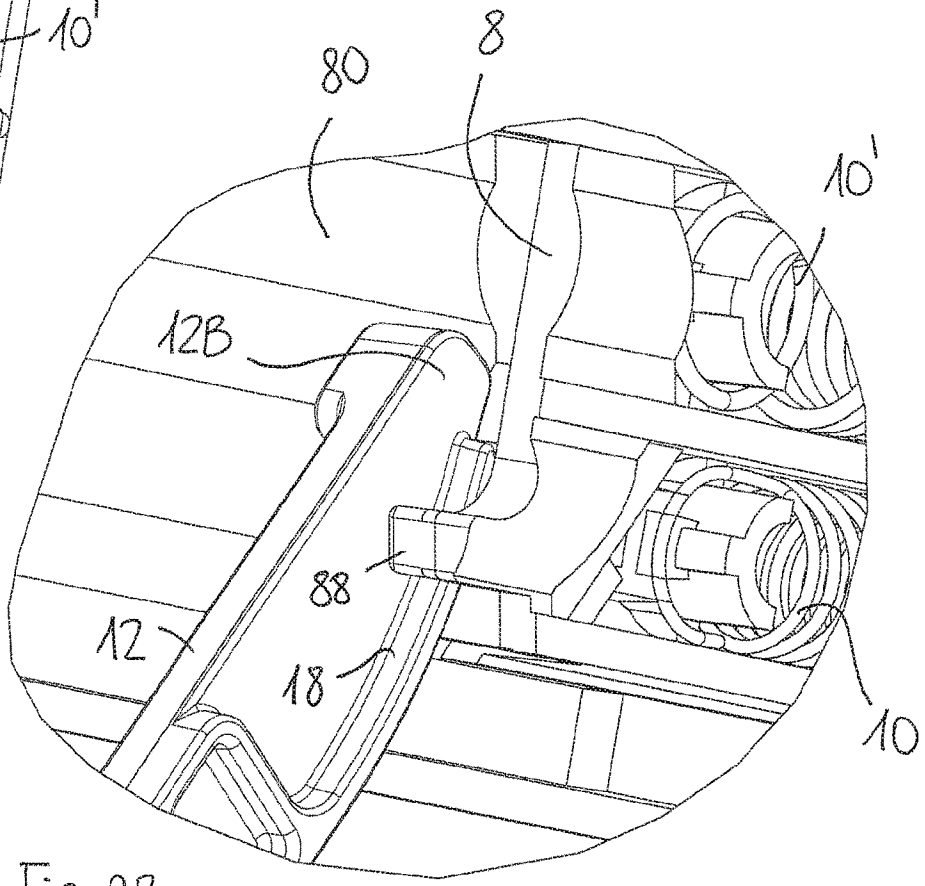
FIG. 9B shows an enlarged view of the circled constructive detail of FIG. 9A.
Figure 9A:
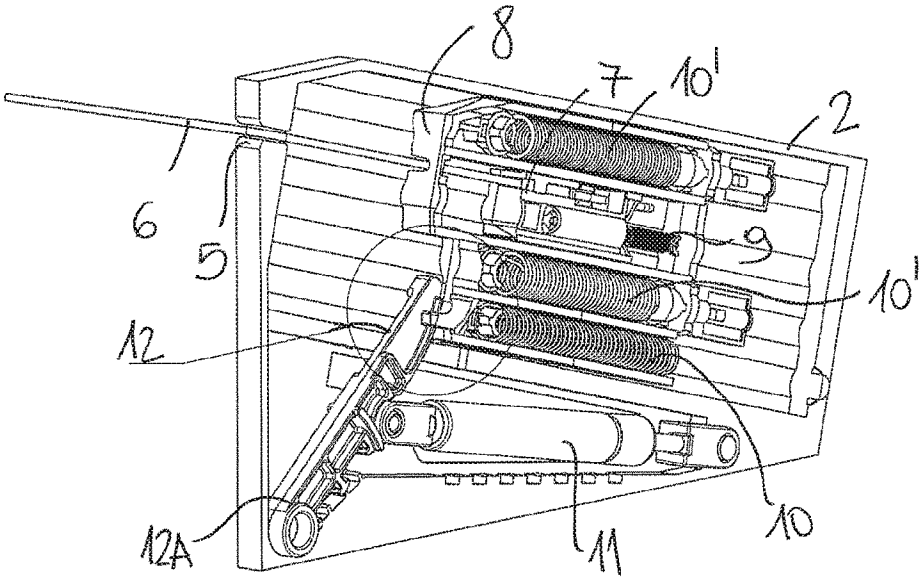
FIG. 9A shows a perspective view of the control device according to the present invention during an operating phase of the closing movement of the door wing.

According to an advantageous characteristic of the present invention, described with reference to FIGS. 9A and 9B, on the free end 12B of said arm 12 there is obtained a longitudinal groove 18 preferably arcuate, adapted to receive a relative engagement tooth 88 projecting from a front edge of said second slide 8.

During the opening movement of the door wing A, when said second slide 8 reaches said second end 12B of the actuating arm 12, said engagement tooth 88 arranges itself on the relative groove 18, anyway without producing any effect on the travel of the second slide 8. Advantageously, on the contrary, during the closing movement of the door wing A, said engagement tooth 88 remains inserted in the relative groove 18, allowing said second slide 8 to displace at the same time also said arm 12, to reactivate said damping means 11.

Said groove 18 is advantageously configured so that when said damping means 11 again reaches the resting condition, that is the condition wherein said shank 11A is inserted inside the relative casing 11B, said tooth 88 exits the same groove, allowing said second slide 8 to continue its travel towards the respective first stop position.

Advantageously, if said second spring 10 has an elastic return force of a higher intensity with respect to that of the first spring 9, when said door wing A reaches a position basically near the closed position, said second slide 8 has reached the first stop position; further rotations of the door wing A in the closing direction further decrease the tension of the cable 6, and therefore allow said first spring 9 to elastically return said first slide 7 towards the respective first stop position, with a progressively decreasing force, thus controlling the closing speed of the wing A and avoiding the impact of the same against the body of the piece of furniture M.

According to a further advantageous characteristic of the present invention, said control device 1 further comprises anchoring means 60, adapted to constrain said first end 6A of said cable 6 to the inner surface of the door wing A of the piece of furniture M, advantageously configured so that, at the moment of the assembly, it is possible to easily adjust the length of the cable 6. In fact, the length of the cable 6 that can be used in a device 1 according to the present invention basically depends on the assembly position of said casing 2 with respect to the piece of furniture M and on the depth of the cavity defined by the same piece of furniture.

Figure 10:
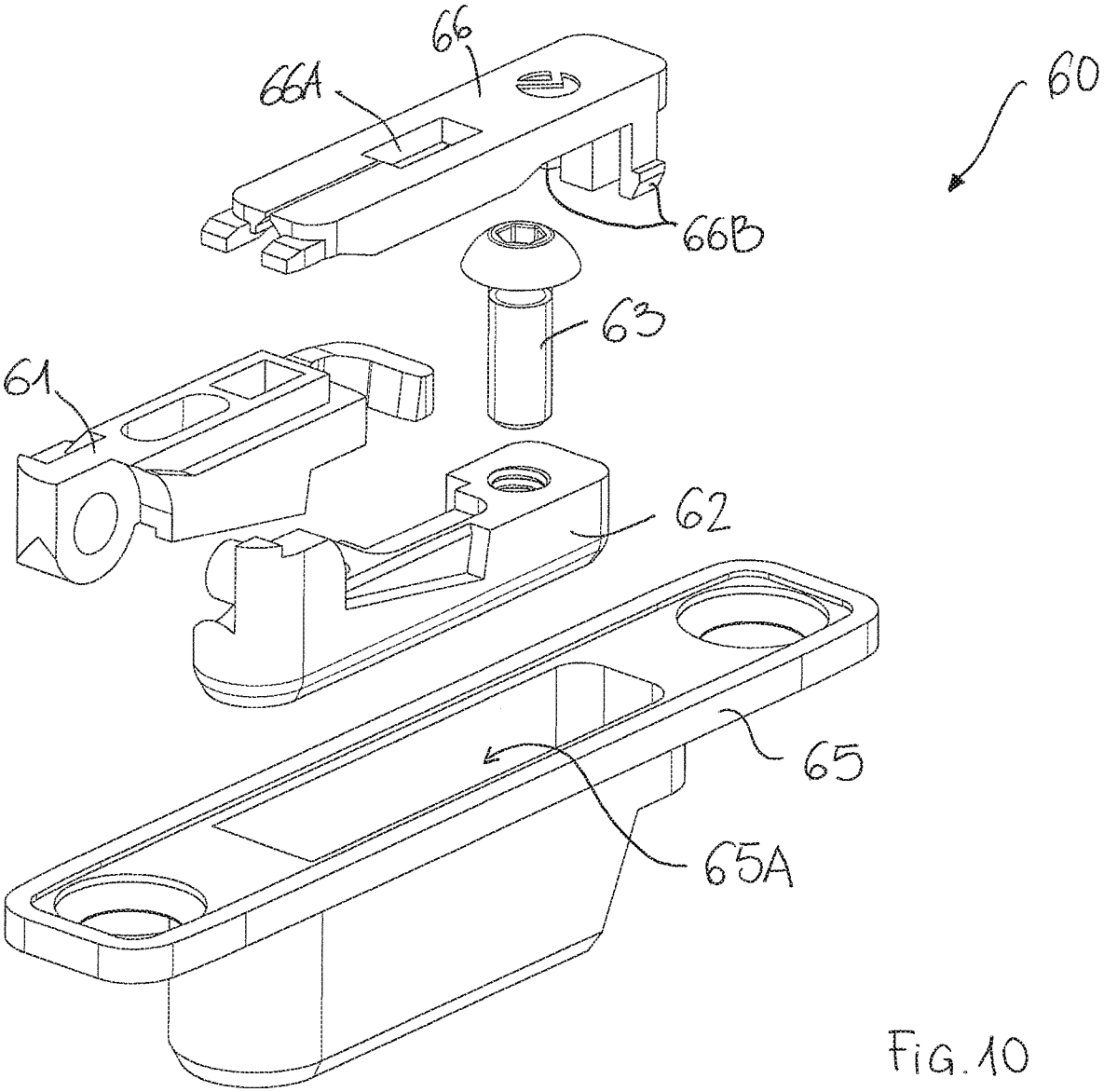
FIG. 10 shows an exploded view of an advantageous component of the control device according to the present invention.
Figure 11A:
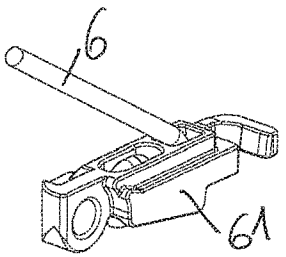
FIGS. 11A to 11G show perspective views of the operating phases in order to carry out the assembly of the component of FIG. 10.
Figure 11B:
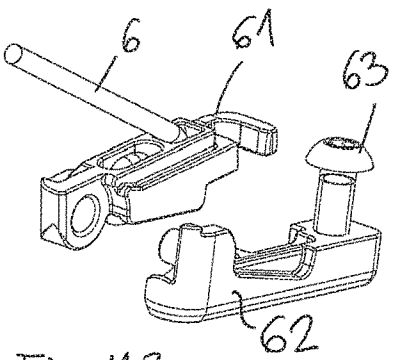
Figure 11C:
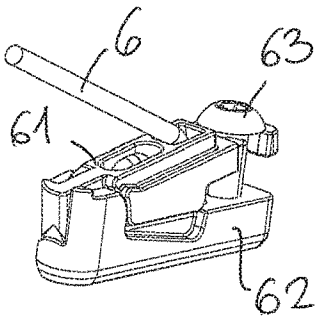
Figure 11D:
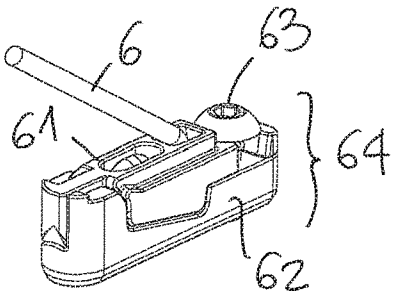
Figure 11E:
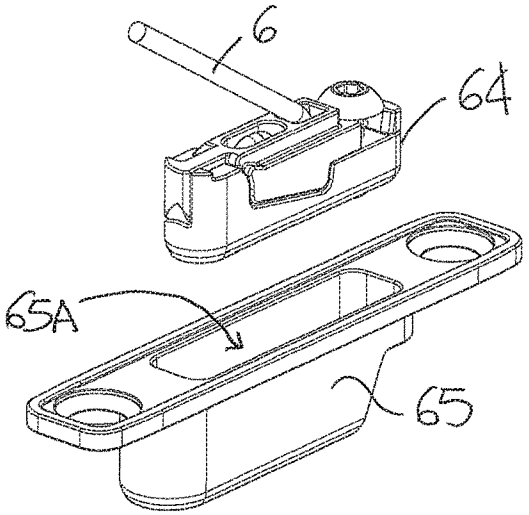
Figure 11F:
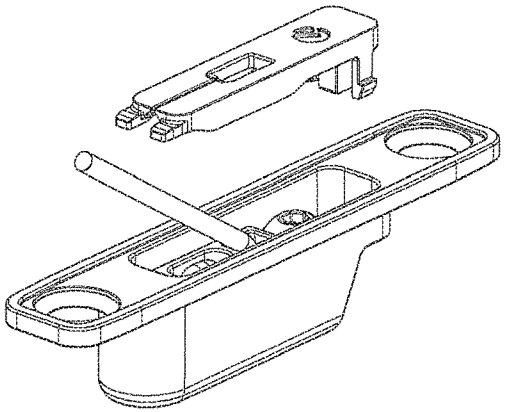
Figure 11G:
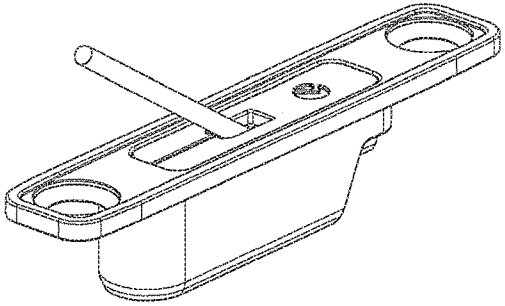

As shown in FIG. 10, said anchoring means 60 basically comprise a first and second blocking body 61, 62, adapted to be connected one to the other through blocking means 63 in order to firmly block a portion of said cable 6 between them, moreover, said anchoring means 60 comprise an anchoring element 65 adapted to be fixed to the door wing A and defining a housing seat 65A, and a covering element 66.

As shown in FIGS. 11A-11G, there are shown the steps to carry out in order to adjust the length and anchor the cable 6 to the door wing A. At first the length of the cable 6 is roughly set, for example using a suitable template, it is then tailored and one of its free end is introduced within said first blocking body 61, in case engaging it provisionally on inner return means.

Said first blocking body 61 is then associated to said second blocking body 62, anyway without carrying out the final blocking, and the holding block 64 thus obtained is removably housed in said housing seat 65A provided in the anchoring element 65 previously fixed to the door wing A. Proceeding iteratively in this way, it is possible to determine more precisely the best length of the cable 6, which is permanently set removing the possible exceeding portion and firmly joining one to the other said blocking bodies 61,62 by means of clamping means 63.

Advantageously, the blocking block 64 thus obtained, now firmly joined to the first end 6A of the cable 6, is permanently housed within said housing seat 65A; said covering element 66, provided with a through slotted opening 66A through which it is possible to allow the passage of the cable 6, is then slidably placed on said seat 65 A and pushed fit to the anchoring element 65 by means of a pair of elastic tabs 66B.

Advantageously, the tension of the cable 6 can be set when mounting the device 1 on the piece of furniture M also in correspondence of the opposed end 6B of the cable 6, acting on the adjustment means 70 preferably provided on said first slide 7 and shown in FIG. 12.

Said first slide 7 is advantageously obtained from two overlapped portions 71, 72, defining a cavity adapted to house an adjustment element 74, such as a screw provided with a threaded shank integral to an operation head 74A, for example formed by a toothed head. Advantageously, said cavity is provided with a stop wall 72A adapted to firmly hold into position said head 74A, in order to avoid axial translations of said adjustment element 74.

The second end 6B of the cable 6 is constrained to a blocking body 73 provided with a through hole 73A internally threaded and adapted to engage the thread of the shank of said adjustment element 74.

An operation opening 75 is advantageously obtained on the upper portion 71 of said first slide 7, and realized so as to be able to reach the operation head 74A with a suitable tool in order to drag into rotation said adjustment element 74, thus adjusting the position of the blocking body 73 with respect to the threaded shank, and therefore giving the desired tension to the cable 6.

In conclusion, from the foregoing it is apparent how a device 1 for controlling the opening/closing of door wings of pieces of furniture according to the present invention allows to achieve the previously expected objects and advantages.

In fact, thanks to advantageous arrangement on the rear of the back R of the piece of furniture, said device 1 is basically completely hidden from view, and does not take up the usable space inside the cavity of the piece of furniture. Concurrently, this arrangement does not affect in any way the functionality of the same device, as there are provided suitable guiding means 200 which allow its normal use.

Furthermore, it is apparent that a control device 1 according to the present invention is very easy to assemble and, with time, it ensures a high level of robustness and reliability, besides allowing a quick replacement of possibly damaged elements or means, anyway promptly available on the market.

Advantageously, said control device 1 is provided with a plurality of means and elements which make it possible to carry out an easy and quick adjustment based on the weight (and on the dimensions) of the door wing A to be controlled, also when installing the same, allowing a great flexibility of use.

Furthermore, thanks to the presence of a first and second elastic means 9, 10, 10' adapted to be actuated at different times of the travel of the door wing A, it is offered a differentiated elastic return force, so as to ensure a smooth displacement of the same door wing, both when opening and when closing.

Of course, the present invention can have a great number of applications, modifications or variants without exiting its scope as defined in the appended claim 1. Furthermore, the materials and equipment used to realize the present invention, as well as the forms and dimensions of the individual components, can be the most suitable according to specific requirements.

The invention claimed is:

1. A device for controlling the opening/closing of a door wing of a piece of furniture having a body comprising at least a sidewall and a back, and defining an inner cavity, the device comprising:

a casing adapted to be mounted on said piece of furniture body;

an inextensible cable, associable at a first end with said door wing and extending with respect to the casing between a retracted position, wherein the door wing is in a closed position, and an extracted position, wherein said door wing is in an opened position, tilted downwards with respect to the body of the piece of furniture; and displacing means connected to the cable and movable with respect to the casing, the displacing means comprising elastic means, wherein the casing is configured to be arranged outside the back, a first guiding means configured to be arranged on the sidewall and being provided for guiding the cable along said sidewall, a second guiding means being provided for perpendicularly deviating the cable with respect to said first guiding means.

2. The device according to claim 1, wherein the first guiding means comprising a grooved straight conduit adapted to be associated with an inner surface of the sidewall and extending horizontally along the depth of the inner cavity defined by the piece of furniture.

3. The device according to claim 1, wherein the second guiding means is provided at an opening obtained on the casing to allow the insertion of the cable, the opening being configured so as to orthogonally deviate the direction of the cable.

4. The device according to claim 1, wherein the second guiding means comprises a transmission element arranged outside with respect to the casing and adapted to cooperate with the cable in order to orthogonally deviate the direction of the cable.

5. The device according to claim 1, wherein the elastic means comprises at least a first spring operatively associated with a second end of the cable.

6. The device according to claim 5, wherein the displacing means comprises sliding members comprising at least a first slide associated with the first spring and slidably movable within the casing, the second end of the cable being anchored to the first slide.

7. The device according to claim 6, wherein the displacing means further comprises a damping means adapted to be actuated by the sliding members when the door wing is reaching the opened position.

8. The device according to claim 6, wherein the sliding members further comprise a second slide slidably movable within the casing, the first slide being slidably mounted on the second slide.

9. The device according to claim 8, wherein the elastic means further comprises at least a second spring associated with the second slide, the displacing movement of the second slide being triggered by the cable through said first slide.

10. The device according to claim 5, wherein the at least a first spring is associated to means for recovering the length of the cable rotatably mounted in the casing.

11. A piece of furniture provided with a body comprising at least a sidewall and a back, and defining an inner cavity closable with a door wing, the piece of furniture comprising the device according to claim 1.

* * * * *